US006964305B2

(12) United States Patent
McMahan et al.

(10) Patent No.: US 6,964,305 B2
(45) Date of Patent: Nov. 15, 2005

(54) CUP SEAL EXPANSION TOOL

(75) Inventors: Michael E. McMahan, Humble, TX (US); Steve Rosenblatt, Haddonfield, NJ (US)

(73) Assignee: Baker Hughes Incorporated, Houston, TX (US)

( * ) Notice: Subject to any disclaimer, the term of this patent is extended or adjusted under 35 U.S.C. 154(b) by 67 days.

(21) Appl. No.: 10/638,840

(22) Filed: Aug. 11, 2003

(65) Prior Publication Data

US 2004/0031615 A1 Feb. 19, 2004

Related U.S. Application Data

(60) Provisional application No. 60/403,002, filed on Aug. 13, 2002.

(51) Int. Cl.[7] ..... E21B 43/00

(52) U.S. Cl. ..... 166/380; 166/207; 166/384

(58) Field of Search ..... 166/380, 384, 166/206, 207

(56) References Cited

U.S. PATENT DOCUMENTS

| | | | | | |
|---|---|---|---|---|---|
| 2,812,025 | A | * | 11/1957 | Teague et al. | 166/207 |
| 3,419,080 | A | * | 12/1968 | Lebourg | 166/207 |
| 3,477,506 | A | * | 11/1969 | Malone | 166/207 |
| 3,712,115 | A | | 1/1973 | Miller et al. | |
| 4,069,573 | A | * | 1/1978 | Rogers et al. | 29/890.031 |
| 4,099,563 | A | | 7/1978 | Hutchison et al. | |
| 4,149,566 | A | | 4/1979 | Stowe | |
| 5,794,702 | A | | 8/1998 | Nobileau | |
| 5,803,177 | A | | 9/1998 | Hriscu et al. | |
| 6,478,091 | B1 | * | 11/2002 | Gano | 166/373 |
| 6,648,075 | B2 | * | 11/2003 | Badrak et al. | 166/381 |
| 6,742,598 | B2 | * | 6/2004 | Whitelaw et al. | 166/387 |
| 2002/0020524 | A1 | | 2/2002 | Gano | |
| 2003/0000709 | A1 | * | 1/2003 | Gano | 166/380 |

FOREIGN PATENT DOCUMENTS

| | | |
|---|---|---|
| EP | 1097760 A2 | 5/2001 |
| WO | PCT/FR00/00784 | 10/2000 |
| WO | PCT/GB01/04958 | 10/2002 |

* cited by examiner

*Primary Examiner*—William Neuder
(74) *Attorney, Agent, or Firm*—Steven Rosenblatt

(57) ABSTRACT

In one variation, a tool is disclosed that can run cladding into casing where the cladding interior is closed off by opposed cup seals and access to the volume between the cup seals exists through the tool body. "Cladding" comprises sleeves, scrolls, casing, tubing and liner strings. Pressure is applied to the interior of the cladding to expand it into gripping and sealed contact with the casing. An exterior gripping surface can be provided on the cladding to enhance grip upon expansion. The tool can be repositioned to expand lengths of cladding including tubing or casing.

23 Claims, 2 Drawing Sheets

CUP SEAL EXPANSION TOOL

PRIORITY INFORMATION

This application claims the benefit of U.S. Provisional Application No. 60/403,002 on Aug. 13, 2002.

FIELD OF THE INVENTION

The field of this invention is tools that expand tubulars and more particularly tools that employ pressure retained by cup shaped seals to accomplish the expansion.

BACKGROUND OF THE INVENTION

In the late 1990s the technique of expansion of tubulars started to become widely used downhole. There were several applications such as casing patches, screen expansions in lieu of gravel packing, and expansion of casing or slotted liners as part of well completion. Different mechanical swages were devised that could be pushed or pulled through tubulars. These swages were of the fixed dimension variety or incorporated rollers that had the ability to extend or retract. Another technique that was developed utilized inflatable bladders to perform the expansion.

While these techniques were effective, they had drawbacks. Mechanical swages could get stuck before the expansion was complete and were problematic to use if there was any significant deviation in the wellbore. Rigid tubing was necessary in order to be able to transmit significant pulling forces from the surface to the swage. The inflatables proved costly to run and, due to their complexity, occasionally failed to inflate or burst due to well conditions during run in or when in position for inflation. The nature of inflatables limited the available expansion force due to the pressure rating of the inflatable. What was needed was a simpler technique that could expand a tubular downhole that did not have the limitations of the known techniques described above.

Cup type seals have been in oilfield use for a long time. They have, among other things, been used to pressure test tubulars for pinhole leaks or fractures. One such device is illustrated in U.S. Pat. No. 4,149,566 in its FIG. 5. It describes the test rig involving a mandrel with opposed test cups to isolate the zone to be pressure tested with fluid to be delivered between the cups. This reference describes the limited reliability of predecessor test cups to withstand the rigors of testing thousands of feet of tubulars and the need for frequent cup replacements.

Yet, despite the use of test cups for pressure testing tubing being known since the 1970s and the rapid commercialization of the expansion of tubulars downhole in the late 1990s, there has heretofore been no known device that incorporates the use of cup type seal elements in a device to expand tubulars. The present invention allows, among other applications, the insertion of cladding into existing casing and expanding it into a sealed engagement with existing casing. In the context of this application "cladding" comprises, among other things, a sleeve or a scroll that stays expanded due to a ratchet or other device, casing or tubing. It can also be used to expand casing or tubing. Depending on the mounting of the cup seals, the tool can be repositioned to sequentially expand long lengths of cladding, casing or tubing. These and other advantages will be more apparent to those skilled in the art from a review of the description of the preferred embodiment and the claims below.

Also related to cladding expansion are U.S. Pat. Nos. 2,812,025 (showing expansion of a scroll downhole), 4,099,563 and 5,803,177(showing packer cups used in a downhole tool).

SUMMARY OF THE INVENTION

In one variation, a tool is disclosed that can run a section of cladding into casing where the cladding interior is closed off by opposed cup seals and access to the volume between the cup seals exists through the tool body. Pressure is applied to the interior of the cladding to expand it into anchored and sealed contact with the casing. An exterior gripping surface can be provided on the cladding to enhance grip upon expansion. The tool can be repositioned to expand lengths of cladding.

DETAILED DESCRIPTION OF THE PREFERRED EMBODIMENT

Figure 1:
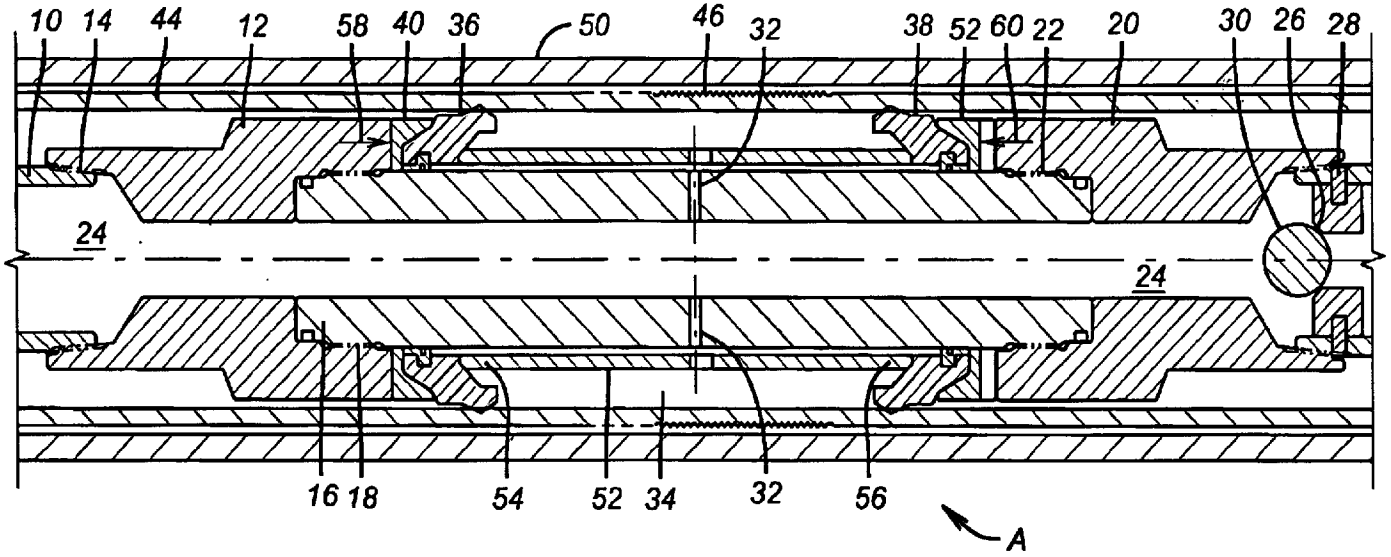
FIG. 1 is a section view of the apparatus running in a cladding into casing.
Figure 3:
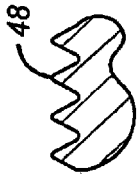
FIG. 3 is a detailed view of the teeth pattern on the exterior of the cladding to promote grip upon expansion.

Referring to FIG. 1 a work string 10 is connected to top sub 12 at thread 14. Top sub 12 is connected to body 16 at thread 18. Bottom sub 20 is connected at thread 22 to body 16. Passage 24 extends through top sub 12, body 16 and bottom sub 20. A ball seat 26 is connected to bottom sub 20 and shear pins 28 secure its position. A ball 30 can be dropped on seat 26 to allow passage 24 to be pressurized. Passage 24 has lateral outlets 32 that lead to annular space 34 outside body 16 and between cup seals 36 and 38, which are respectively backed by thimbles 40 and 42. Cladding 44 has been pushed over cup seals 36 and 38 to close off annular space 34. A running tool (not shown) is attached to work string 10 so that cladding 44 can be supported from the work string 10. The cladding 44 has an exterior tooth profile 46 made up of a plurality of teeth 48, shown in detail in FIG. 3. Teeth 48, upon expansion of sleeve 44, dig into casing 50.

Figure 2:
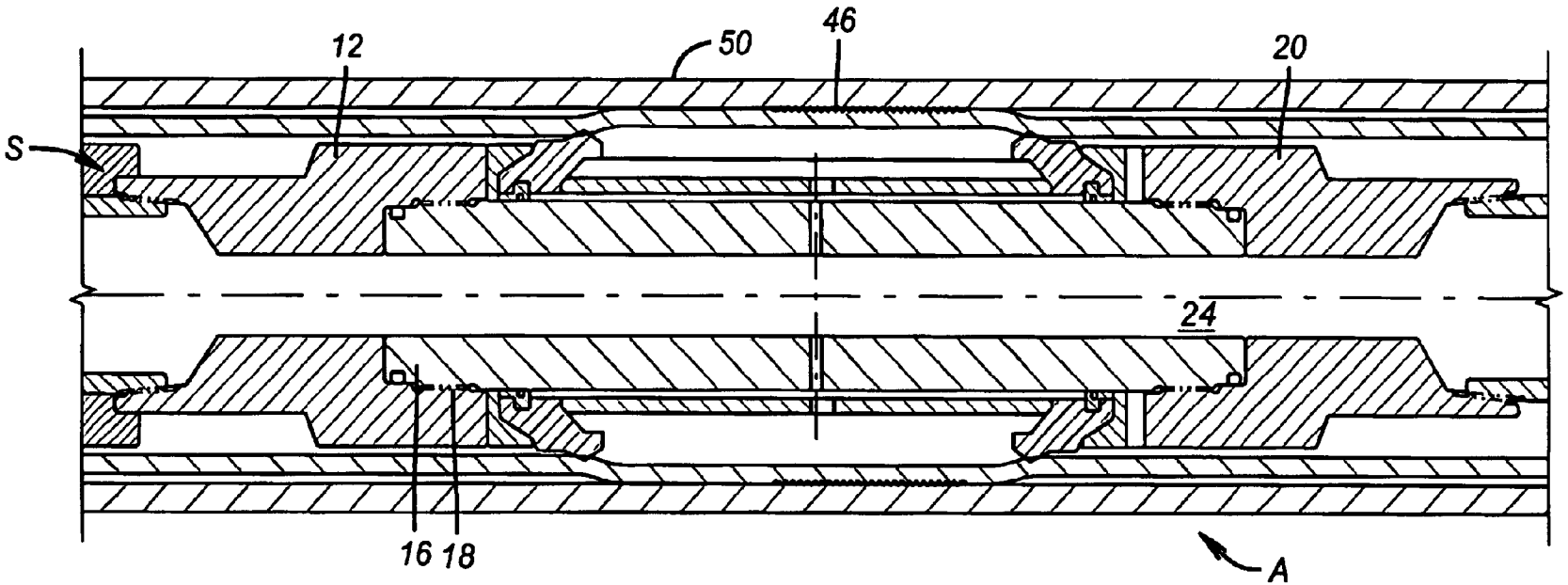
FIG. 2 is the view of FIG. 1 in the cladding-expanded position.

In operation, a ball 30 is dropped on seat 26 and pressure upwards of 10,000 pounds per square inch (PSI) is applied. The pressure is communicated between cup seals 36 and 38 to expand sleeve 44 into sealing contact with casing 50. Teeth 48 dig into casing 50 to secure cladding 44. Cup seals 36 and 38 can be in pairs near the upper and lower ends of the cladding 44 so that the expansion, as well as sealing and anchoring, will be at opposed ends of the cladding. Alternatively, the cup seals 36 and 38 can be at one end, preferably the lower end, of cladding 44 so that upon expansion, one end is sealed and anchored. Thereafter, a swage S, shown schematically in FIG. 2 as located above cup seals 36 and 38 but which can also be placed between them, can be energized to run from the expanded zone of the cladding 44 by pulling the work string, which supports the swage uphole and out of the cladding 44 to expand the balance of the cladding. Sleeve 52 is used to keep cups 36 and 38 separate and at opposite ends of annular space 34 during tool assembly. When the expansion of cladding 44 is complete, the ball seat is released by further pressure application to break shear pins 28. The work string 10 can be pulled without pulling a wet string, as the passage 24 is again open at the bottom. It should be noted that the bottom sub could have a check valve instead of ball seat 26. The check a valve allows fluid into passage 24 for run in but prevents fluid from passing in the opposite direction. When it is time to pull the work string 10, the entire check valve assembly can be blown out by raising pressure in passage 24 and breaking shear pins that hold the check valve. Yet other ways to temporarily block the passage 24 to allow expansion with pressure applied between cup seals 36 and 38 are within the scope of the invention. The cup seals 36 and 38 are commercial products available from Global Elastomeric Products located in Bakersfield, Calif., under the product designation 5½" 15/17# Packer Cup w/O-Ring Groove 80/90 HD (E105502H6291189). The expansion of the sleeve 44 allows the work string to be removed from the well as the sleeve remains in sealed contact with the casing 50. The apparatus described can also expand cladding into tubing as well as casing 50. It should also be noted that the expansion could be accomplished on a volumetric basis of fluid pumped between the cup seals 36 and 38. A positive displacement pump can be used or/and some type of flow measurement to insure that the proper amount of expansion is achieved without over-expansion. The annular space could be vented to allow it to fill with a known volume of fluid short of expansion of the cladding 44, at which point the vent can close and a predetermined volume pumped in to get the desired expansion. In a variation, the annular space 34 can be initially evacuated to dispense with the need for a vent.

In an alternative embodiment the apparatus A can be reconfigured so that it can be repositioned for repeated uses, such as expansion of long lengths of casing, tubing, liners or cladding. To do this the backing rings 40 and 42 can be reconfigured to extend outwardly a little more and are mounted to be selectively responsive to an applied force, represented schematically by arrows 58 and 60. When this happens in the absence of pressure in annular space 34 the cup seals 36 and 38 can flex sufficiently to move the apparatus A without damage to the cup seals 36 and 38. After movement of the apparatus A the backing rings 40 and 42 can be retracted and the cycle is repeated.

Those skilled in the art will appreciate that this technique is far more economical than using an inflatable or a swage. A pressure booster (not shown) can be located above the apparatus A so that surface pressures in the order of about 3,000 PSI can be boosted at the apparatus A to over 10,00 PSI. The cup seals are usable to high temperatures in excess of 200 degrees Fahrenheit. The cup seals can be stored on site and quickly renewed, if necessary, during a lengthy expansion or if otherwise damaged when cladding 44 is passed over them.

While the preferred embodiment has been described above, those skilled in the art will appreciate that other mechanisms are contemplated to accomplish the task of this invention, whose scope is delimited by the claims appended below, properly interpreted for their literal and equivalent scope.

We claim:

1. A method of expanding a tubular downhole, comprising:

providing an expansion tool comprising a pair of seals spaced from each other on a body;

positioning said tubular and said expansion tool in the wellbore;

pressurizing the tubular between said seals;

expanding the tubular providing a swage on said body; and completing at least a part of said expansion by axially moving said swage in said tubular.

2. The method of claim 1, comprising:

repositioning said expansion tool in the tubular after said positioning the tubular in the wellbore.

3. The method of claim 1, comprising:

expanding the length of said tubular in a sequence of alternating pressurizing and repositioning the expansion tool with respect to the tubular.

4. The method of claim 1, comprising:

providing a gripping feature on the exterior of the tubular to enhance grip after expansion.

5. The method of claim 1, comprising:

providing a retraction capability on at least one of said seals.

6. The method of claim 5 comprising:

repositioning said body with respect to said tubular with said seal retracted.

7. The method of claim 5, comprising:

providing opposed cup seals as said seals;

flexing at least one of said cups inwardly toward said body; and repositioning said body with respect to said tubular.

8. The method of claim 7 comprising:

backing a at least one cup seal with a thimble;

moving said thimble with respect to its adjacent cup seal to flex said cup seal inwardly toward said body.

9. The method of claim 1, comprising:

providing opposed cup seals as said seals.

10. The method of claim 1, comprising:

anchoring the tubular in the wellbore in at least one location with said expansion tool.

11. The method of claim 10, comprising:

expanding another portion of the tubular with said swage.

12. The method of claim 10, comprising:

using more than one expansion tool;

anchoring said tubular in at least two locations with said expansion tools.

13. The method of claim 12, comprising:

anchoring the tubular near its opposed ends.

14. A method of expanding a tubular downhole, comprising:

providing an expansion tool comprising a pair of seals spaced from each other on a body;

positioning said tubular and said expansion tool in the wellbore;

pressurizing the tubular between said seals; and expanding the tubular;

providing a flow path through said body;

selectively blocking said flow path to allow said pressurizing.

15. The method of claim 14, comprising:

reopening said flow path;

avoiding pulling a wet string when removing said expansion tool from the wellbore due to said reopening.

16. The method of claim 15, comprising:

dropping an object on a seat to selectively block said flow path.

17. The method of claim 15, comprising:

providing a check valve in said passage;

allowing fluid to enter said flow path as said body is lowered into the well; and forcing said check valve out of said flow path to avoid pulling a wet string when removing said body from the wellbore.

18. The method of claim 14, comprising:

providing a gripping feature on the exterior of the tubular to enhance grip after expansion.

19. A method of expanding a tubular downhole, comprising:

providing an expansion tool comprising a pair of seals spaced from each other on a body;

positioning said tubular and said expansion tool in the wellbore;

pressurizing the tubular between said seals; and expanding the tubular;

providing a flow path through said body;

providing a pre-measured volume of fluid between said seals to obtain a predetermined volume of expansion of said tubular.

20. A method of expanding a tubular downhole, comprising:

providing an expansion tool comprising a pair of seals spaced from each other on a body;

positioning said tubular and said expansion tool in the wellbore;

pressurizing the tubular between said seals; and expanding the tubular;

providing a flow path through said body;

venting the annular space between said body and said seals prior to said pressurizing.

21. A method of expanding a tubular downhole, comprising:

providing an expansion tool comprising a pair of seals spaced from each other on a body;

positioning said tubular and said expansion tool in the wellbore;

pressurizing the tubular between said seals; and expanding the tubular;

providing a flow path through said body;

evacuating the annular space between said body and said seals prior to said pressurizing.

22. A method of expanding a tubular downhole, comprising:

providing an expansion tool comprising a pair of seals spaced from each other on a body;

positioning said tubular and said expansion tool in the wellbore;

pressurizing the tubular between said seals; and expanding the tubular;

providing opposed cup seals as said seals;

flexing at least one of said cups inwardly toward said body; and repositioning said body with respect to said tubular.

23. The method of claim 22, comprising:

backing a at least one cup seal with a thimble;

moving said thimble with respect to its adjacent cup seal to flex said cup seal inwardly toward said body.

* * * * *